US007753607B2

(12) United States Patent
Tan et al.

(10) Patent No.: US 7,753,607 B2
(45) Date of Patent: Jul. 13, 2010

(54) MEDIA INPUT TRAY HAVING MOVABLE DATUM MEMBERS

(75) Inventors: Wee-Lian Tan, Singapore (SG); Kok-Wah Aw, Singapore (SG); Boo-Siong Lim, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 843 days.

(21) Appl. No.: 11/456,211

(22) Filed: Jul. 9, 2006

(65) Prior Publication Data

US 2008/0008514 A1 Jan. 10, 2008

(51) Int. Cl.
*B65H 1/04* (2006.01)

(52) U.S. Cl. ..... 400/624; 400/633; 399/393; 271/145; 271/241

(58) Field of Classification Search ..... None
See application file for complete search history.

(56) References Cited

U.S. PATENT DOCUMENTS

| | | | | |
|---|---|---|---|---|
| 4,030,725 A | | 6/1977 | Fukui et al. | |
| 4,786,042 A | * | 11/1988 | Stemmle | 271/171 |
| 5,110,106 A | * | 5/1992 | Matsumura et al. | 271/171 |
| 5,238,167 A | * | 8/1993 | Howard et al. | 227/110 |
| 5,292,116 A | | 3/1994 | Inoue et al. | |
| 5,803,631 A | | 9/1998 | Bingham et al. | |
| 6,213,659 B1 | * | 4/2001 | Elgee | 400/633 |
| 6,276,852 B1 | * | 8/2001 | Osmus | 400/624 |
| 6,536,968 B2 | | 3/2003 | Lee et al. | |
| 6,688,592 B1 | | 2/2004 | Tan et al. | |
| 7,510,181 B2 | * | 3/2009 | Kozaki | 271/171 |
| 2007/0280768 A1 | * | 12/2007 | Allwright | 400/624 |

* cited by examiner

*Primary Examiner*—Jill E Culler

(57) ABSTRACT

A removable media input tray for holding a stack of media sheets is provided. The input tray is configured so that it can be fitted into a chassis of a printing apparatus. The input tray includes a reference guide wall and at least two datum members movably attached to the reference guide wall. The reference side wall is formed with at least two openings through which portions of the datum members extend. The input tray also includes a width adjuster, which is configured to bias the stack of media sheets against the datum members. The datum members are brought into contact with a side wall of the chassis when the input tray is inserted into the chassis, thereby causing the datum members to be aligned to the same side wall.

13 Claims, 5 Drawing Sheets

MEDIA INPUT TRAY HAVING MOVABLE DATUM MEMBERS

FIELD OF THE INVENTION

The present invention relates generally to a media input tray and a printing apparatus having the same.

BACKGROUND

Many computer printing apparatuses, such as inkjet printers, include a removable input tray for holding a stack of media sheets and a sheet feeding mechanism for separating and delivering individual media sheets from the media stack to a media path in the printing apparatus. Typically, the input tray is provided with at least one adjustable edge guide and a fixed, reference side wall. This type of tray requires the user to load a stack of sheets against the reference side wall, and use the adjustable edge guide to bias the stack of sheets against the reference side wall. Proper positioning of the media sheets in the input tray is a first step in correctly feeding the media through the printing apparatus. It is desirable for each sheet to be aligned as accurately as possible when the sheet initially enters the media path. If the top sheet of the stack is not properly aligned when it enters the media path, the printed image on the sheet will be skewed. To facilitate the alignment of the media sheets, the reference side wall is conventionally provided with one or more datum members (or edge stops), against which the stack of sheets is biased. These datum members are usually permanently fixed on the reference side wall, e.g. molded parts of the side wall. As such, the alignment of the media sheets depends on the alignment of the input tray relative to the printing axis. Due to variations in manufactured parts, the input tray with fixed datum members may not be properly oriented when all the printer's parts are assembled. As a consequence, additional alignment mechanisms and skew correction mechanisms are required to ensure proper alignment of the input tray relative to the printing axis. Furthermore, when the datum members are worn out due to wear and tear overtime, the entire tray has to be replaced. Such replacement is costly. Therefore, there exists a need for a removable media input tray with improved datum members.

SUMMARY

The present invention provides a removable input tray for holding a stack of media sheets. The input tray is configured so that it can be fitted into a chassis of a printing apparatus. The input tray includes a reference guide wall and at least two datum members movably attached to the reference guide wall. The reference side wall is formed with at least two openings through which portions of the datum members extend. The input tray also includes a width adjuster, which is configured to bias the stack of media sheets against the datum members. The datum members are brought into contact with a side wall of the chassis when the input tray is inserted into the chassis, thereby causing the datum members to be aligned to the same side wall of the chassis.

The objects and advantages of the present invention will become apparent from the detailed description when read in conjunction with the drawings.

DETAILED DESCRIPTION

Figure 1:
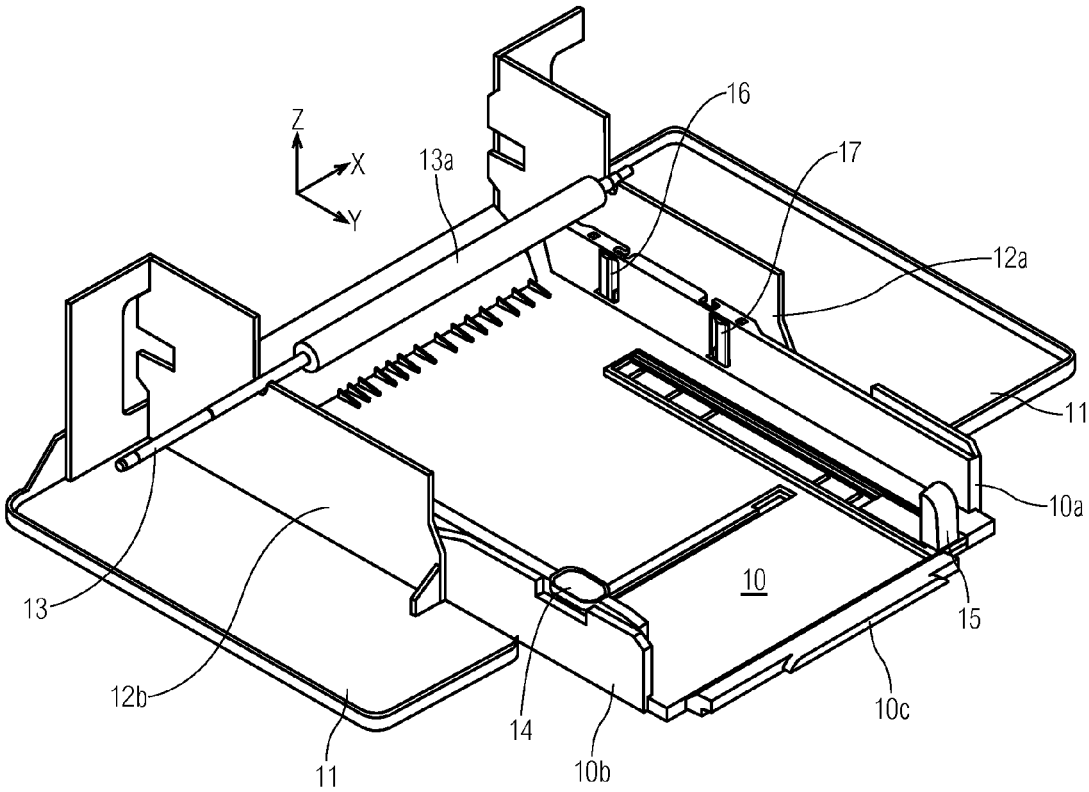
FIG. 1 is a perspective view showing a removable media input tray and a printer's chassis adapted for receiving the input tray in accordance to an embodiment of the present invention.

The print cycle of a conventional printing apparatus, e.g. inkjet printer, includes picking a media sheet from an input tray, feeding it through the printer, and then expelling it through the printer's output port. During printing, a pen carriage, carrying one or more ink cartridges, reciprocally moves along a guide rod and ejects ink droplets onto the media sheet to generate a desired printed image. The present invention provides a media input tray adapted for use in such printing apparatus. FIG. 1 is a perspective view showing a removable media input tray 10 and a printer's chassis 11 adapted for receiving the input tray 10 in accordance to an embodiment of the present invention. Chassis 11 represents generally those structural parts of the printer's housing which support the operational components of the printer. In order to clarify the illustration of input tray 10, most of the operational components of the printer are omitted from FIG. 1. Chassis 11 includes two opposing side walls 12*a* and 12*b*, to which a feed roller shaft 13 is mounted. A feed roller 13*a* is rotatably mounted on the feed roller shaft 13. The feed roller 13*a* is part of the media feeding mechanism that transports an individual media sheet from the media stack to the print zone, where ink ejection occurs. The feed roller shaft 13 is parallel to the printing axis (i.e. X axis) and perpendicular to the direction of the media path (i.e. Y axis). The side walls 12*a* and 12*b* are perpendicular to the feed roller shaft 13. The "X" axis is defined as the axis along which the pen carriage reciprocates during printing. The "Y" axis is perpendicular to the X axis, and is the axis of media travel as the media sheet is fed through the printing apparatus.

Referring to FIG. 1, the input tray 10 is configured so that it can be fitted between the side walls 12*a* and 12*b* of the chassis 11. The input tray 10 has two side walls 10*a* and 10*b*, a handle 10*c*, a width adjuster 14 and a length adjuster 15. The region bound by the width adjust 14, the length adjuster 15 and the side wall 10*a* defines an area for receiving a stack of media sheets (hereafter referred to as "media stack"). By this arrangement, the side wall 10*a* functions as a reference guide wall for the media stack (hereafter referred to as "reference guide wall"). The width adjuster 14 is slidable toward and away from the reference guide wall 10*b* to accommodate different media widths. The length adjuster 15 is adjustable in a direction substantially perpendicular to the reference guide wall 10*a* to accommodate different media lengths. To ensure proper alignment of the media stack, two datum members 16 and 17 are movably attached to the reference guide wall 10*a*.

Figure 2:
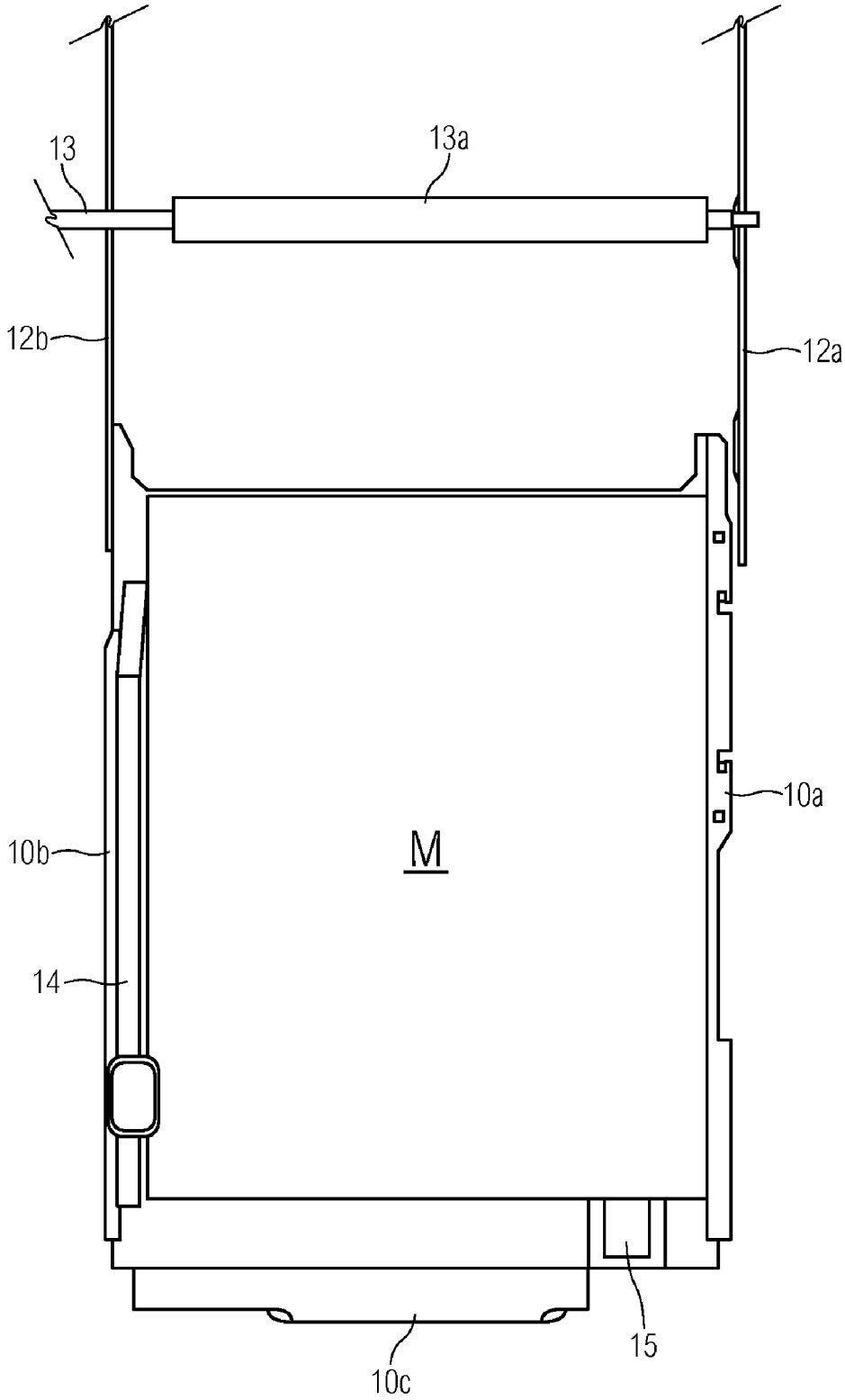
FIG. 2 is a top plan view showing the input tray with a media stack therein before the input tray is inserted into the chassis.

FIG. 2 is a top plan view showing the input tray 10 with a media stack M before the input tray is fully inserted between the side walls 12*a* and 12*b* of chassis 11. The insert direction of the input tray is depicted by arrow F. The media stack M should be properly aligned relative to the X axis (i.e., the feed roller shaft 13) in order to avoid skewed feeding of the media sheets. The width adjuster 14 is configured to exert a resilient bias force against the media stack M to urge the media stack against the datum members 16 and 17. As an example, the width adjuster 14 may be provided with a conventional biasing spring to produce such resilient bias force.

Figure 3:
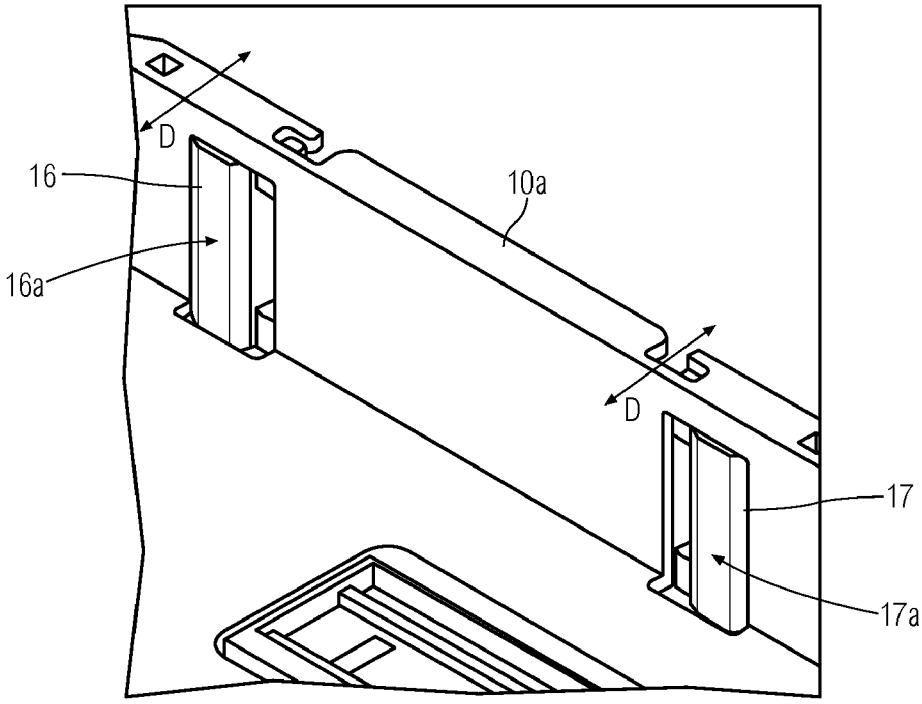
FIG. 3 is a close-up perspective view showing two datum members, which are movably attached to a side wall of the input tray shown in FIG. 1.
Figure 4:
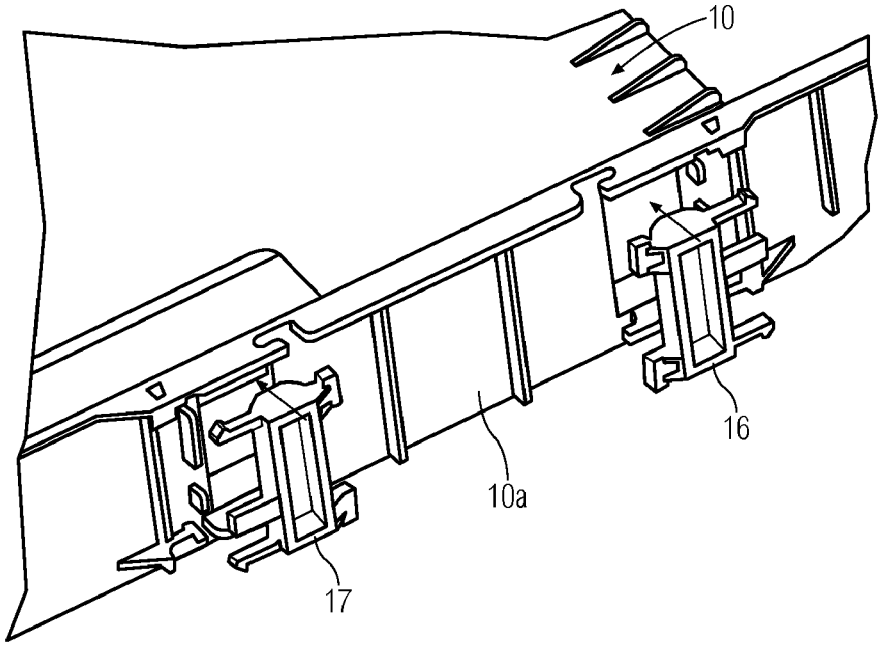
FIG. 4 is a close-up perspective view showing the datum members detached from the side wall of the input tray.

Referring to FIG. 3, the reference guide wall 10*a* of input tray 10 is provided with openings through which portions of the datum members 16 and 17 extend. The datum members 16 and 17 include media contact surfaces 16*a* and 17*a*, respectively, against which one side edge of the media stack is biased when the media stack is loaded into the input tray 10. The datum members 16 and 17 are movably attached to the reference guide wall 10*a* so that they are allowed to move slightly (i.e., jiggle) from side to side in the direction substantially perpendicular to the reference guide wall 10*a* (depicted by arrows D). The reference guide wall 10*a* and the datum members 16 and 17 are configured so that the datum members can be manually snapped onto and manually detached from the reference guide wall 10*a*. FIG. 4 shows the datum members 16 and 17 being detached from the side wall 10*a*. Because the datum members 16 and 17 are detachable from the input tray 10, they can be easily replaced when they are worn out without having to replace the entire tray. In one embodiment, the datum members 16 and 17 are made of a wear-resistant material such as Teflon or polycarbonate. The datum members 16 and 17 may be made of a material that is different from the other parts of the input tray 10. Thus, the body of the input tray 10 may be made of a material that is relatively cheap, and the datum members 16 and 17 may be made of a more expensive, wear-resistant material. While only two datum members are shown in the above embodiment, it should be understood by those skilled in the art that more than two datum members are possible.

Figure 5:
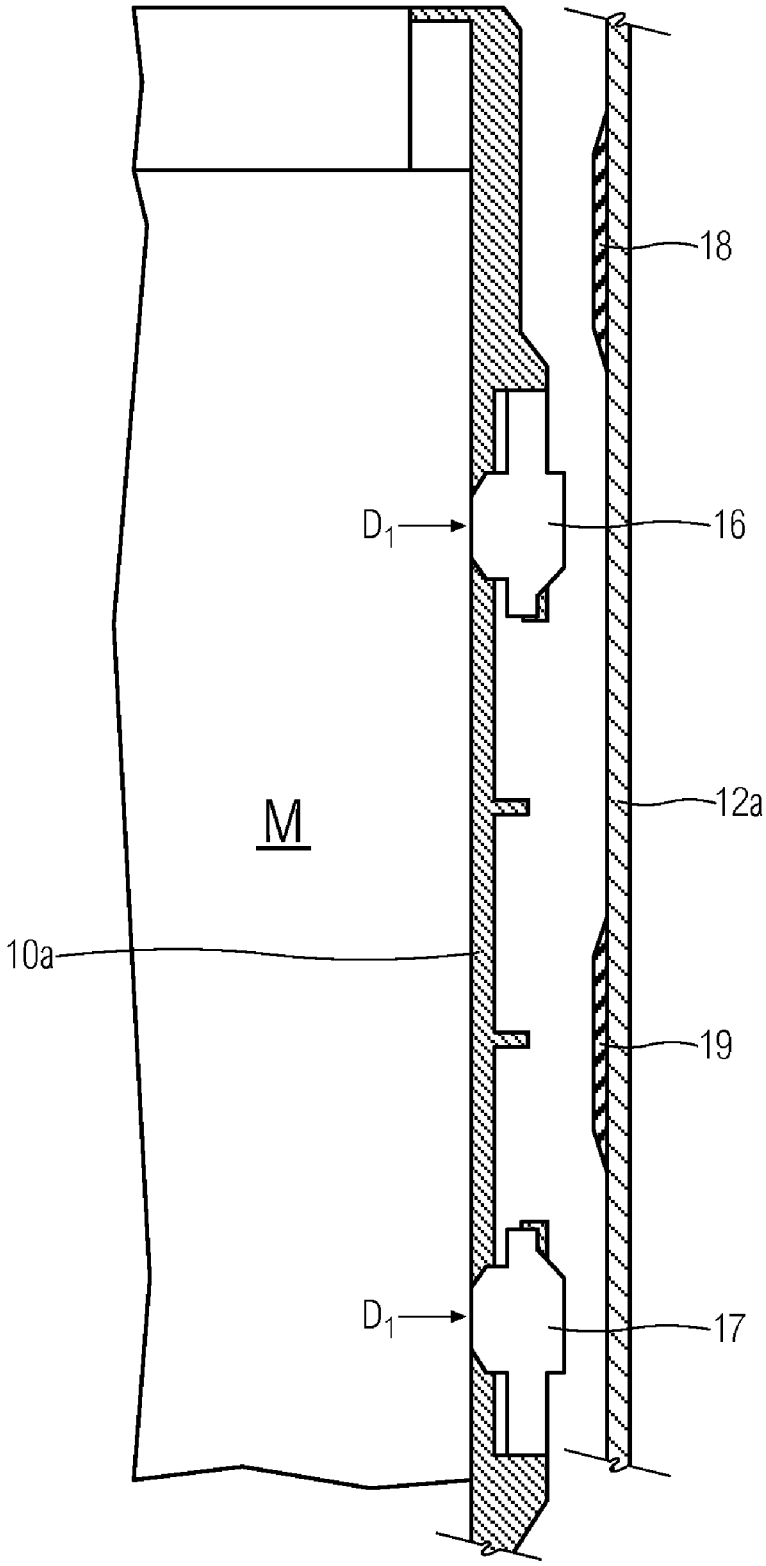
FIG. 5 is a cross-sectional view showing the position of the datum members before the input tray is inserted into the chassis.

FIG. 5 is a cross-sectional partial view showing the position of the datum members 16 and 17 before the input tray 10 with a media stack therein is inserted into the chassis 11. When the input tray 10 is removed from the chassis 11 and the media stack M is loaded into the input tray 10, one side edge of the media stack M is biased against the datum members 16 and 17 due to the biasing force applied by the width adjuster 14, thereby pushing the datum members 16 and 17 in an outward direction depicted by arrows $D_1$ in FIG. 5. The side wall 12*a* of chassis 11 is provided with protruding portions 18 and 19, which are positioned so as to abut the datum members 16 and 17, respectively, when the input tray 10 is inserted into the chassis 11.

Figure 6:
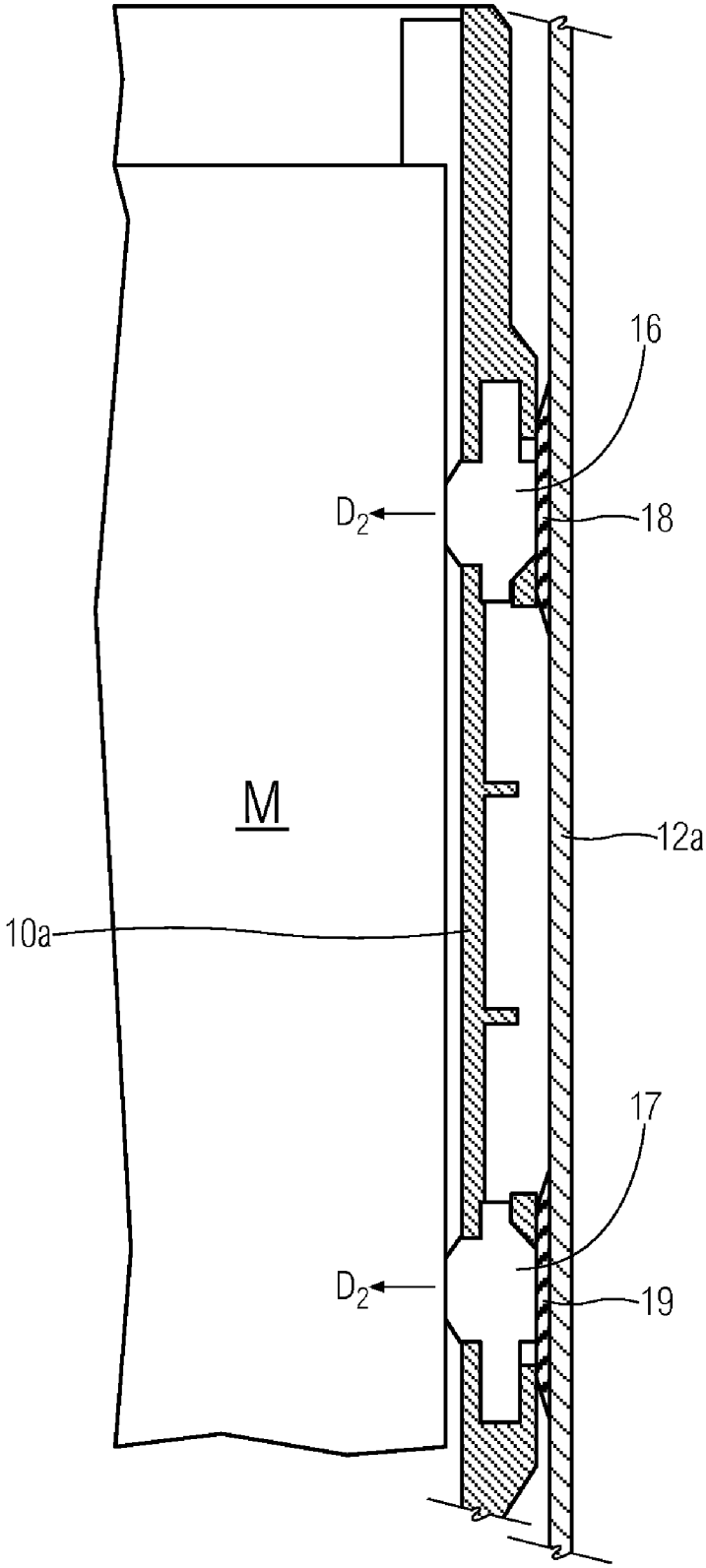
FIG. 6 is a cross-sectional view showing the position of the datum members after the input tray is inserted into the chassis.

FIG. 6 is a cross-sectional partial view showing the position of the datum members 16 and 17 relative to the side wall 12*a* of chassis 11 after the input tray 10 is inserted into the chassis 11. When the input tray 10 is inserted into the chassis 11, the datum members 16 and 17 are abutted against the protruding portions 18 and 19 on side wall 12*a* due to the configuration of the chassis 11. As a result, the datum members 16 and 17 are pushed in an inward direction depicted by arrows $D_2$ in FIG. 6 while being biased against the protruding portions 18 and 19, thereby causing the media stack to shift slightly in direction $D_2$. In this way, the datum members 16 and 17 are caused to align to the side wall 12*a*, and consequently, the media stack is caused to align to the same side wall 12*a*. Furthermore, any skew that exists in the media stack before the input tray 10 is inserted into the chassis 11 will be corrected by the movable datum members 16 and 17. It has been determined that the side wall 12*a* of chassis 11 provides a good reference for properly aligning the media sheets relative to the printing axis because printing begins from the right side of the media sheet. Accordingly, aligning the datum members 16 and 17 relative to the side wall 12*a* effectively provides a proper media stack orientation for the purpose of feeding the media sheets into the printing apparatus.

While particular embodiments of the present invention has been disclosed in detail in the foregoing description and drawings, it will be understood by those skilled in the art that variations and modifications thereof can be made without departing from the scope of the invention as set forth in the following claims.

What is claimed is:

1. A removable input tray for supporting a stack of media sheets, said input tray comprising:

a reference guide wall having at least two openings;

at least two datum members movably attached to the reference guide wall such that portions of the datum members extend through said openings, said datum members being movable from side to side in a direction substantially perpendicular to the reference guide wall; and a width adjuster movable toward and away from the reference guide wall, said width adjuster being configured to bias a stack of media sheets against the datum members, wherein said datum members are movably attached to the reference guide wall further such that said datum members are permitted to jiggle from side to side in the direction substantially perpendicular to the reference guide wall.

2. The removable input tray of claim 1, wherein said datum members are formed of a material selected from the group consisting of Teflon and polycarbonate, and said material is different from the materials forming other parts of the input tray.

3. The removable input tray of claim 1, wherein the reference guide wall and the datum members are configured so that the datum members can be manually snapped onto and manually detached from the reference guide wall.

4. The removable input tray of claim 1, wherein said datum members are formed of a material that is more wear-resistant than materials forming other parts of the input tray.

5. The removable input tray of claim 1, wherein said datum members are movably attached to the reference guide wall such that said datum members are permitted to jiggle from side to side in the direction substantially perpendicular to the reference guide wall without employing a spring mechanism.

6. A printing apparatus comprising:

a chassis having two opposing side walls; and a removable input tray for supporting a stack of media sheets, said input tray being removably insertable between the two side walls of the chassis, said removable input tray comprising:

(i) a reference guide wall having at least two openings;

(ii) at least two datum members movably attached to the reference guide wall such that portions of the datum members extend through said openings, said datum members being movable from side to side in a direction substantially perpendicular to the reference guide wall; and (iii) a width adjuster movable toward and away from the reference guide wall, said width adjuster being configured to bias the stack of media sheets against the datum members, wherein, when the input tray is inserted into the chassis, the reference guide wall is positioned adjacent to one side wall of the chassis and the datum members are brought into contact with the same side wall, thereby causing the datum members to be aligned to the same side wall, and wherein said datum members are movably attached to the reference guide wall further such that said datum members are permitted to jiggle from side to side in the direction substantially perpendicular to the reference guide wall.

7. The printing apparatus of claim 6, wherein said one side wall of the chassis comprising protruding portions on an inner surface that faces the reference guide wall when the input tray is inserted into the chassis, and said datum members are brought into contact with said protruding portions.

8. The printing apparatus of claim 7, wherein, when the stack of media sheets is loaded into the input tray and the input tray is inserted into the chassis, the datum members are biased against the protruding portions on said one side wall of the chassis, thereby causing the stack of media sheets to be aligned to said one side wall.

9. The printing apparatus of claim 6, wherein said datum members are formed of a material selected from the group consisting of Teflon and polycarbonate, and said material is different from the materials forming other parts of the input tray.

10. The printing apparatus of claim 6, wherein the reference guide wall and the datum members are configured so that the datum members can be manually snapped onto and manually detached from the reference guide wall.

11. The printing apparatus of claim 6 further comprising a feed roller shaft on which a feed roller rotatably mounted, wherein the side wall of the chassis that is in contact with the datum members is positioned substantially perpendicular to said feed roller shaft.

12. The printing apparatus of claim 6, wherein said datum members are formed of a material that is more wear-resistant than materials forming other parts of the input tray.

13. The printing apparatus of claim 6, wherein said datum members are movably attached to the reference guide wall such that said datum members are permitted to jiggle from side to side in the direction substantially perpendicular to the reference guide wall without employing a spring mechanism.

* * * * *